US009435501B2

(12) United States Patent
Tubb, Jr.

(10) Patent No.: US 9,435,501 B2
(45) Date of Patent: Sep. 6, 2016

(54) MOUNTING ADAPTER FOR POLE-MOUNTED LIGHTS

(71) Applicant: L. C. Tubb, Jr., Fort Worth, TX (US)

(72) Inventor: L. C. Tubb, Jr., Fort Worth, TX (US)

( * ) Notice: Subject to any disclaimer, the term of this patent is extended or adjusted under 35 U.S.C. 154(b) by 0 days.

(21) Appl. No.: 14/816,615

(22) Filed: Aug. 3, 2015

(65) Prior Publication Data

US 2016/0146412 A1 May 26, 2016

Related U.S. Application Data

(60) Provisional application No. 62/084,674, filed on Nov. 26, 2014.

(51) Int. Cl.

| | |
|---|---|
| ***F21S 8/08*** | (2006.01) |
| ***F21V 21/30*** | (2006.01) |
| ***F21V 21/116*** | (2006.01) |
| *F21Y 101/02* | (2006.01) |
| *F21W 131/103* | (2006.01) |

(52) U.S. Cl.

CPC ..... *F21S 8/086* (2013.01); *F21V 21/116* (2013.01); *F21V 21/30* (2013.01); *F21W 2131/103* (2013.01); *F21Y 2101/02* (2013.01)

(58) Field of Classification Search

CPC ..... F21S 8/086; F21V 21/30; F21V 21/116; F21W 2131/103; F21Y 2101/02

See application file for complete search history.

(56) References Cited

U.S. PATENT DOCUMENTS

| | | | | |
|---|---|---|---|---|
| 3,678,265 | A | 7/1972 | Porter et al. | |
| 4,115,845 | A | 9/1978 | Blahut | |
| 4,237,530 | A | 12/1980 | Murray et al. | |
| 4,726,552 | A | 2/1988 | Warshawsky | |
| 5,975,726 | A | 11/1999 | Latimer | |
| 6,280,056 | B1 | 8/2001 | Dolan et al. | |
| 6,416,207 | B1 * | 7/2002 | Chang | F21S 6/003 362/249.07 |
| 7,246,918 | B2 | 7/2007 | Ginsburg | |
| 7,566,150 | B2 | 7/2009 | Adrien | |
| 8,240,895 | B2 | 8/2012 | Lin et al. | |
| 2004/0201999 | A1 | 10/2004 | Yueh | |
| 2011/0310596 | A1 | 12/2011 | Ahmadi | |

FOREIGN PATENT DOCUMENTS

| | | | |
|---|---|---|---|
| DE | 3112503 | A1 | 11/1982 |

* cited by examiner

*Primary Examiner* — Stephen F Husar

(74) *Attorney, Agent, or Firm* — Geoffrey A. Mantooth; Brian K. Yost

(57) ABSTRACT

An outside lighting arrangement comprises a vertical pole with upper and lower ends. A mounting member is coupled to the upper end of the pole, which mounting member has plural luminaire mounting positions located circumferentially about the pole and offset from the pole. Plural directional luminaires are provided. A mounting adaptor comprising a first portion that couples to the mounting at one of the light mounting positions, and a second portion that couples to one of the luminaires, is provided. The second portion is rotatively coupled to the first portion so as to direct light from the luminaire in the desired direction. The mounting adaptors can be used on existing selections, as well as new installations.

14 Claims, 7 Drawing Sheets

MOUNTING ADAPTER FOR POLE-MOUNTED LIGHTS

This application claims the benefit of provisional application, Ser. No. 62/084,674, filed Nov. 26, 2014.

FIELD OF THE INVENTION

The present invention relates to pole-mounted lighting, such as can be found along roads, rest stops, parking lots and the like.

BACKGROUND OF THE INVENTION

High mast lighting is used to illuminate a relatively large area of ground from a small number of locations. The lights are located at the top of a tall mast or pole. The height of the tall mast allows light to travel relatively far from the base of the mast.

A typical application of high mast lighting is along roadways, such as highways. Interchanges in particular utilize high mast lighting. Due to the high speeds of vehicles on highways, an interchange involves use of long roads and/or widely curved roads or loops to enter and exit a particular highway. Consequently, an interchange may involve a relatively large area of the land.

Rest stops also use high mast lighting to illuminate buildings and parking areas.

Unfortunately, highway interchanges, rest stops and other places that use high mast lighting may abut residential neighborhoods. Residential inhabitants do not appreciate tall lights illuminating their houses and yards all night long.

In addition to high mast lighting, shorter pole-mounted lights may cause similar suffering for illuminating unwanted areas. For example in a parking lot, such as for retail stores, the parking lot is illuminated at night. But, a neighborhood may abut the parking lot. Also, biking and hiking trails may wind through neighborhoods, with such trails being illuminated at night for safety reasons. Just like along a highway, the neighborhood abutting the parking lot and hiking and biking trail may view the light as unwanted.

There is a need then to direct light from a pole-mounted lighting arrangement away from nearby areas.

SUMMARY OF THE INVENTION

An outside lighting arrangement, comprises a vertical pole having a lower end mounted to the ground and an upper end. A mounting member is coupled to the upper end of the pole, the mounting member having plural luminaire mounting positions, located circumferentially around the pole and offset from the pole. The arrangement has plural luminaires, each luminaire having a front and a rear, with each luminaire being directional. A mounting adaptor comprises a first portion that couples to the mounting member at one of the luminaire mounting positions, and a second portion that couples to one of the luminaires. The second portion is rotatably coupled to the first portion so as to direct light from the luminaire in the desired direction.

In one aspect, the luminaire mounting positions each comprises a tenon projecting from the mounting member.

In another aspect, the first portion comprises a first mounting tube having two ends, with one end of the first mounting tube coupled to one of the tenons. The first portion comprises a first extension tube that extends from the first mounting tube, the first extension tube rotatably coupled to the second portion.

In another aspect, the second portion comprises a second mounting tube and a second extension tube, the second mounting tube having two ends, with one end coupled to the respective luminaire, the second extension tube extending from the second mounting tube, the second extension tube being telescopically coupled to the first extension tube.

In another aspect, the other end of the first extension tube is closed and the other end of the second extension tube is closed.

In another aspect, the mounting member is horizontal.

In another aspect, the pole has a dark side and a light side, with at least one of the luminaire mounting positions being on the dark side, the luminaires oriented so as to direct light toward the light side and away from the dark side.

In another aspect, each of the luminaires directs its light toward the luminaire front.

In another aspect, at least one of the luminaires is oriented about the pole so that the respective front is away from the pole and another one of the luminaires is oriented about the pole so that respective front is toward the pole.

A method of modifying an outside lighting arrangement used to illuminate a lighted area and located adjacent to a dark area is provided. The outside lighting arrangement comprises a vertical pole, a mounting member and a plurality of directional luminaires. Luminaire mounting positions are located on the mounting member. Those luminaire mounting positions that are adjacent to the dark area are identified. Those identified luminaire mounting positions that are adjacent to the dark area are provided with mounting adaptors. The respective luminaires are mounted to the mounting member by the mounting adaptors. The luminaires on the mounting member are oriented so as to direct light away from the dark area and toward the light area.

In one aspect, the mounting member is lowered from an upper end of the vertical pole to near the ground level so as to provide mounting adaptors to the identified luminaire mounting positions.

DESCRIPTION OF THE PREFERRED EMBODIMENT

The present invention allows lights, or luminaires, to be mounted to a pole-mounted light arrangement, which luminaires can be positioned so as to direct light toward desirable areas (such as roadways, parking lots, hiking trails, bicycle trails, etc.) and away front undesirable areas (such as residential neighborhoods). The present invention utilizes a mounting adapter to mount the luminaires to a mounting member of the pole-mounted light arrangement. The mounting adapter allows the position or orientation of the luminaires to be adjusted so as to direct light away from undesirable areas. The mounting adapter can be used with regard to existing pole-mounted light arrangements as well as be equipped on newly installed pole-mounted light arrangements.

There are various types of pole-mounted light arrangements. One type utilizes a high mast, to elevate the luminaires well above the ground at heights of 50-160 feet or more. Conventional pole-mounted lights typically use poles less than 50 feet in height. The present invention can be used on both types of light arrangements.

Figure 1:
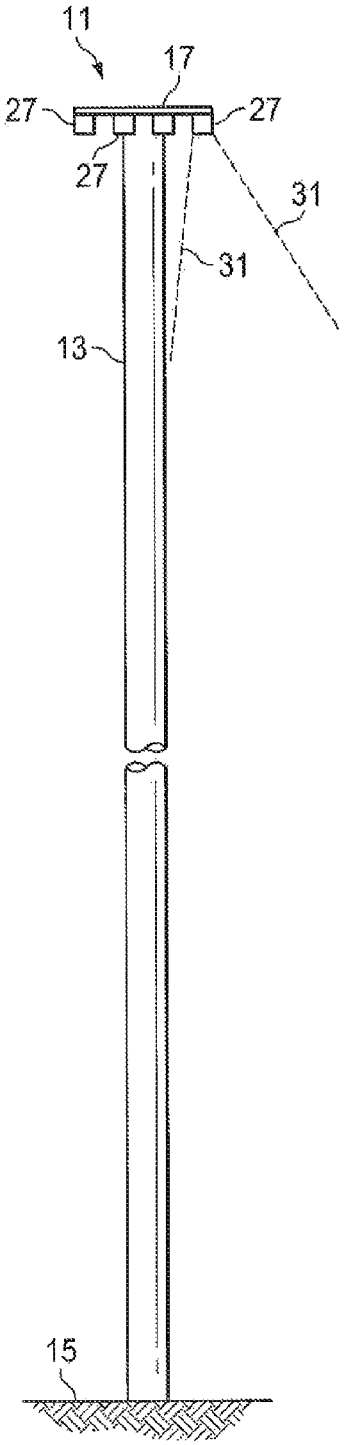
FIG. 1 is an elevational view of a high mast light arrangement.

FIG. 1 shows a typical high mast light arrangement 11. The light arrangement 11 has a pole 13 that extends vertically up from the ground 15. The pole 13, which is also referred to as a mast, extends dozens of feet into the air. At the top of the pole is a mounting member 17. One such type of mounting member 17 is a ring, shown in FIG. 2. The present invention can be used on a variety of mounting members other than a ring. The ring 17 is designed to be lowered down the length of the pole 13 to near the ground 15 to allow maintenance.

Figure 2:
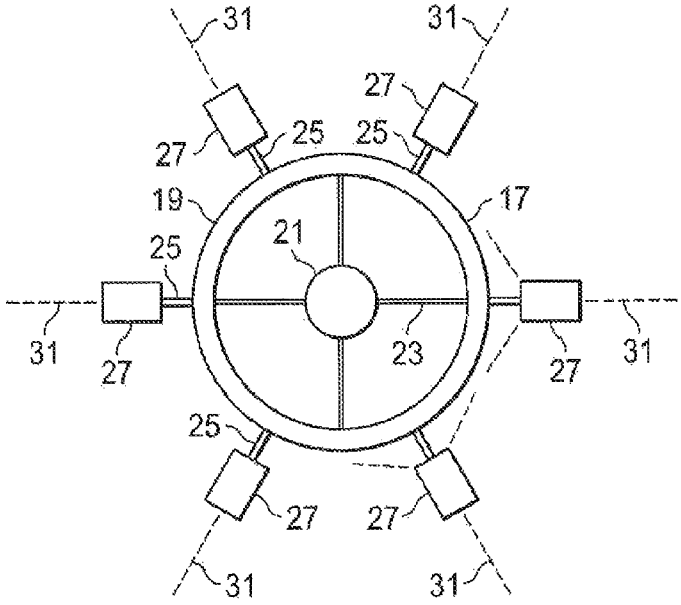
FIG. 2 (PRIOR ART)
FIG. 2 is a plan view of a prior art mounting member for lights for the mast of FIG. 1.
Figure 2A:
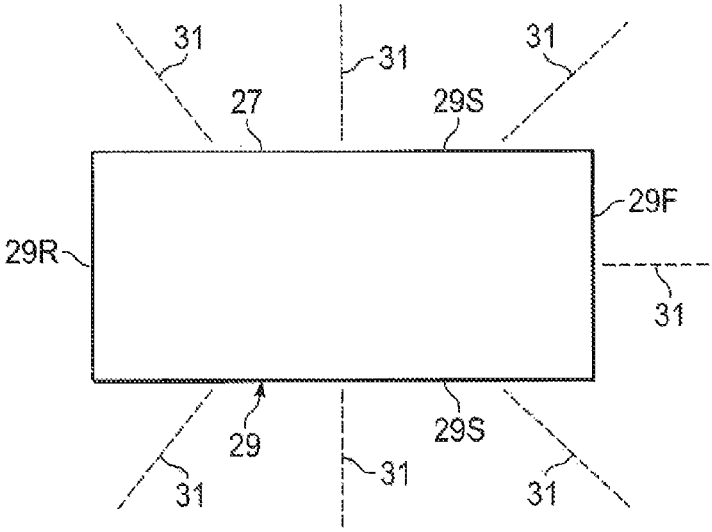
FIG. 2A shows a typical light in plan view.

The ring 17 of FIG. 2 is prior art and has an outer ring 19. The ring has an inner ring 21 and spokes 23 radiating between the inner and outer rings. The pole 13 extends through the inner ring 21. The mounting member 17 is generally horizontal in orientation. Various lifting arrangements (not shown), such as cables and pulleys, as well as latches, are provided to raise and lower the mounting ring 17 and latch it in place at the top of the pole. These are described in U.S. Pat. Nos. 4,115,845; 4,237,530 and 5,975,726, the complete disclosures of which are incorporated herein by reference.

The ring has a number of luminaire mounting positions. In the preferred embodiment, these positions are designated by tenons 25 that extend radially out from the outer ring. Luminaires 27 are mounted to the tenons. With the prior art mounting ring 17, the tenons 25 project radially from the pole in practically all directions. The ring 17 may mount a number of luminaires (for example ranging from 1-12 luminaires).

The luminaires 27 are conventional and commercially available. The lights 27 can be of the LED (light emitting diode) type. Each luminaire has a housing 29 (see FIGS. 2A and 4). The luminaire, if of the LED type, has a light emitter, which is typically a circuit board of LED's, and a driver, that provides electrical power to the circuit board. The luminaire housing protects the components from the elements. The housing typically has a reflector that directs the emitted light 31 in the desired direction from the housing. The housing has a front 29F, a rear 29R, and sides 29S. A typical pattern of the emitted light 31 is shown in FIGS. 1, 2, 2A, and 4 where the emitted light 31 is projected downwardly and mostly out in front (29F) of the luminaire 27, with some light projected rearwardly (29R). In addition, light is directed laterally, or on both sides (29S) of the luminaires. In general the luminaire and its reflector emits light in a downward and forward direction. The amount of light emitted on the sides is determined by the design of the particular reflector. The luminaire 27 is a directional light.

Figure 4:
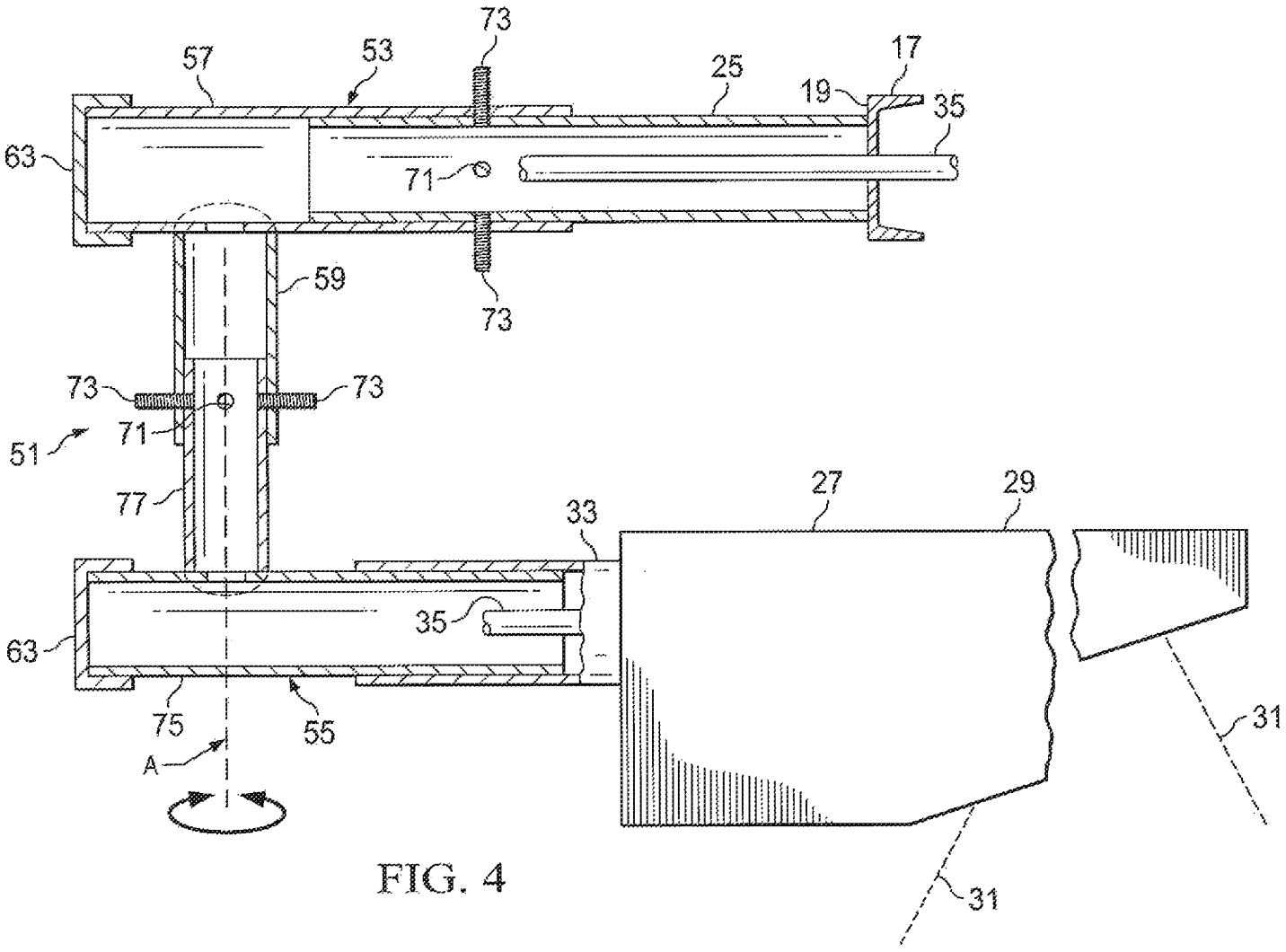
FIG. 4 is an elevational view of a light mounted to a mounting member of the high mast lighting arrangement of FIG. 1, using a mounting adapter of the present invention, in accordance with a preferred embodiment. The fitting for mounting the light is shown cut away.

As shown in FIG. 4, the housing 29 has a fitting 33 for receiving a tenon 25 from the ring 17. The fitting 33 is typically a sleeve or pipe that slides over and on to the tenon. One or more bolts (not shown) extend through the fitting and the tenon to secure the light in place.

Figure 3:
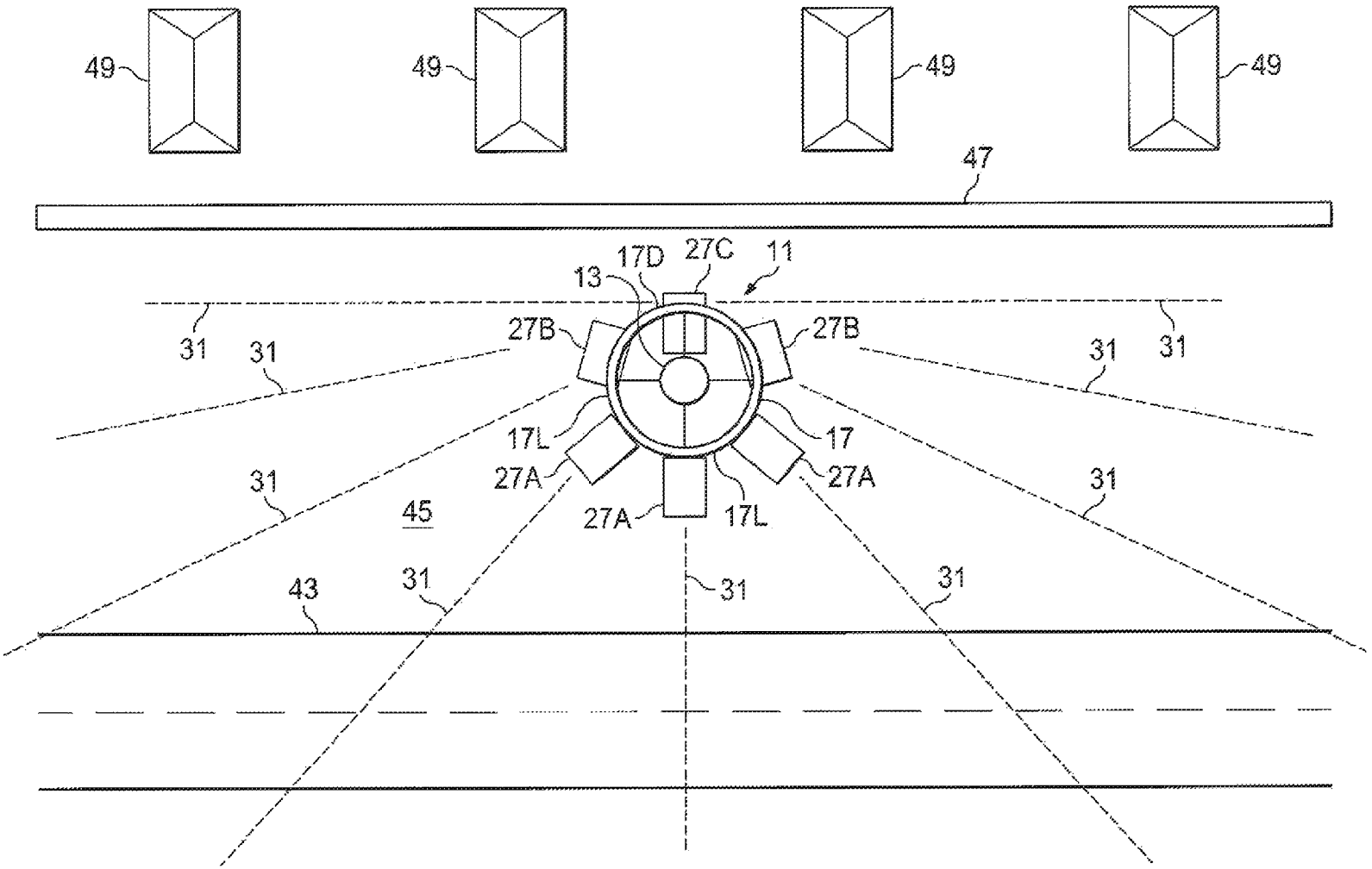
FIG. 3 is a plan view of a high mast light arrangement installed along a roadway and adjacent to a residential neighborhood, which high mast light arrangement incorporates the present invention.

In the prior art, as shown by FIG. 2, light 31 is emitted in 360 degrees about the pole, or in all horizontal directions. The luminaire mounting tenons 25 extend about the circumference of the pole 13. Among other things, this circumferential arrangement prevents shadows of the pole on the ground. Each luminaire 27 is fixed in orientation so that the rear 29R is closest to the ring 17 and the front 29F is furthest away from the ring 17. Each luminaire 27 extends radially out from the ring 17.

Where the prior art light ring arrangement of FIG. 2 emits light in 360 degrees about the pole, the high mast light arrangement 11 of the present invention can be more selective. FIG. 3 illustrates this. The high mast light arrangement 11 is located off to the side of a road way 43, such as a highway. Although two lanes of the roadway are shown, the road way could have more lanes. Further, the road is shown as straight but could be curved. The road could be an interchange or portion of an interchange, which allows vehicular traffic to enter and exit from the road. Alongside the road is a buffer zone 45. The buffer zone may have vegetation such as grass, bushes, etc. Furthermore, the buffer zone may have an auxiliary road. A boundary 47 extends along the buffer zone. The boundary may be a fence, wall, etc. Beyond the boundary is residential area such as a neighborhood 49. The neighborhood contains homes, yards, etc. The boundary 47 separates the residential area from the road area.

The high mast light arrangement 11 is located in the buffer zone 45 adjacent to the road 43. As a consequence, the high mast light arrangement is likely to be located adjacent to the neighborhood 49.

With the present invention, the luminaires 27 are positioned on the mounting member 17 so that the emitted light 31 is directed away from the neighborhood 49 and towards the road 43, as shown in FIG. 3. Thus, the neighborhood 49 is for the most part dark, while the road 43 is well-lit. (Of course the neighborhood could have other sources of light from houses, street lights, etc.)

Figure 5:
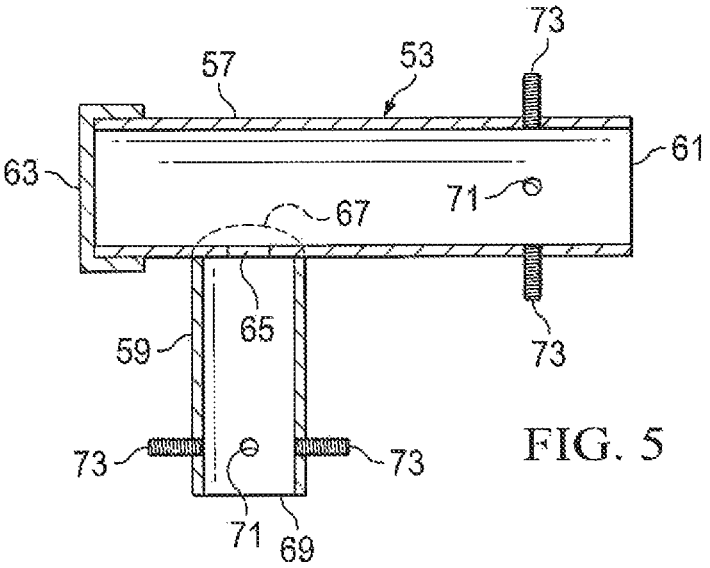
FIG. 5 is an elevational view of a first portion of the mounting adapter of FIG. 4.
Figure 6:
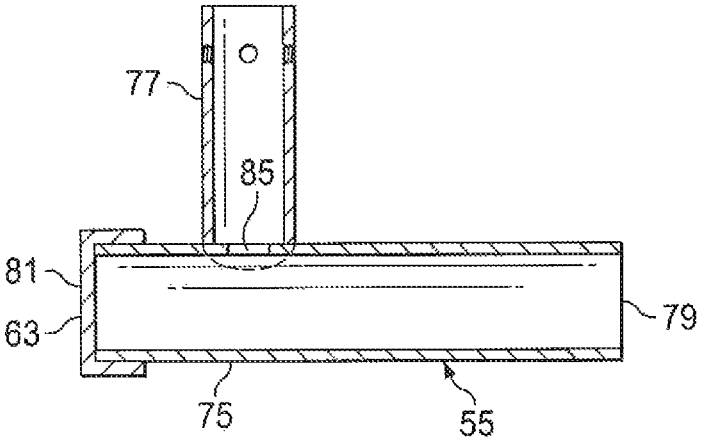
FIG. 6 is an elevational view of a second portion of the mounting adapter of FIG. 4.

This selectively is done by mounting the luminaires 27 to the mounting member 17 by way of mounting adapters 51. Referring to FIGS. 4-6, the mounting adapter 51 includes first and second portions 53, 55. The first portion 53 (FIGS. 4 and 5) mounts to the tenon 25 projecting from the mounting ring 17. The second portion 55 (FIGS. 4 and 6) mounts to the first portion 53 and to the light 27. The second portion 55 can be moved or rotated relative to the first portion 53 to allow the light 27 to be oriented during installation.

The first portion 53 has a first mounting tube 57 and a first extension tube 59. In the preferred embodiment, the two tubes 57, 59 are lengths of pipe. The first mounting tube 57 is open on one end 61 and closed on the other end by a cap 63. The first extension tube 59 extends perpendicularly out from the first mounting tube 57. The first extension tube 59 is located closer to the capped 63 end than the open end 61.

An opening 65 in the first mounting tube allows communication between the interiors of the first mounting tube 57 and the first extension tube 59. In the preferred embodiment the first mounting tube 57 is about twice as long as the first extension tube 59. The first extension tube 59 has a fixed end 67 and a free end 69. The fixed end 67 is coupled to, such as by welding, the outside of the first mounting tube 57. Diametrically opposing holes 71 are formed in the first extension tube 59 near its free end 61. In addition, diametrically opposing holes 71 are formed in the first mounting tube near its open end. Both sets of holes are supplemented with one or more pilot holes and set screws 73.

The second portion 55 has a second mounting tube 75 and a second extension tube 77, and is similar to the first portion 53. The second mounting tube 75 has an open end 79 and a closed end 81 which is closed by way of a cap 63. The second extension tube 77 is sized so as to be telescopically engaged with the first extension tube 59. In the preferred embodiment, the second extension tube 77 fits inside of the first extension tube 59; however, the reverse could be used as well. The free end 79 of the second mounting tube 75 couples to the light 27. The second mounting tube 75 is sized so as to engage the light fitting 33. In the preferred embodiment, the second mounting tube 75 telescopes inside of the fitting 33. An opening 85 in the second mounting tube allows communication between the second mounting tube 75 and the second extension tube 77.

The installation of a luminaire 27 will now be described. The ring 17 is positioned so as to be slightly elevated above the ground but still in reach by personnel. Cabling 35 to power to the light is extended from the ring 17 through the inside the first portion 53, namely through the first mounting tube 57, the opening 65 and the first extension tube 59, out of the free end 69 thereof. The first portion 53 is then mounted to the respective tenon 25 by sliding the first mounting tube 57 onto the tenon (see FIG. 4). The set screws 73 are used to temporary secure the first portion 53 to the tenon. The cabling is inserted through the second portion 55, namely through the second extension tube 77, the opening 85 and the second mounting tube 75 and out the free end 79. Then the second extension tube 77 is inserted into the first extension tube 59 and rotated to the desired position or orientation. The second extension tube 77 rotates with respect to the first extension tube 59. Thus, the second portion 55 and its second mounting tube 75 rotate about a longitudinal axis A that extends through the first and second extension tubes 59, 77. Once the desired orientation is obtained, the second extension tube is held in place by set screws 73 in the first extension tube 59. The luminaire 27 is then mounted to the second portion 55 by sliding the fitting 33 onto the second mounting tube 75. Set screws may be used to secure the light in place to the second mounting tube. The light is then wired to the cabling.

Any final adjustments to the rotational position of the luminaire can be made while the cabling 35 extends through the mounting adapter 51.

Figure 7:
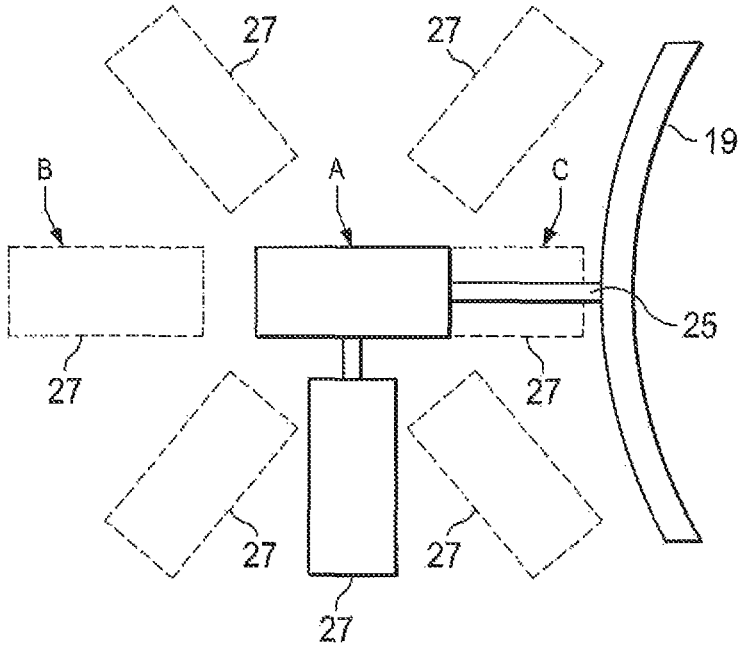
FIG. 7 is a plan view of the mounting adapter and light, shown in various exemplary positions, on a high mast mounting member.

As shown in FIG. 7, the rotational position of the luminaire 27 relative to the ring 17 can be adjusted as desired. The mounting adapter 51 allows the luminaire 27 to be rotated in a horizontal plane about the vertical axis A. If the luminaires is to be configured in the standard orientation, as provided by the prior art light arrangement, the second mounting tube is aligned with the first mounting tube and extends radially out from the ring, as shown by position B in FIG. 7. However, if the light is to be directed toward the pole rather than away the pole, the luminaire is in position C (see FIG. 7) and the first and second mounting tubes are positioned as shown in FIG. 4. The luminaire can be positioned anywhere between these two positions B and C by rotating the second mounting tube relative to the first mounting tube (see dashed examples in FIG. 7).

As shown in FIG. 3, the luminaires are not all oriented radially out from the ring 17. The luminaire or luminaires 27A closest to the road 43 are oriented radially out from the ring, but other luminaires 27B and 27C are not. Lights 27B are oriented with their respective fronts 29F pointed toward the road 43, with one side closest to the pole. As shown in plan view in FIG. 3, the luminaires 27B may be located underneath the ring. Luminaire 27C is oriented in position B shown in FIG. 7, with its front 29F pointed to the pole and its rear 29R pointed to the neighborhood 49. Thus, the emitted light of all of the luminaires 27A, 27B, 27C is directed to the road 43 and away from the neighborhood 49. In many installations, the luminaires 27A, 27B, 27C are oriented so as to be perpendicular to the road 43.

The mounting adapter 51 converts an omni-directional (relative to the ground) pole-mounted light arrangement into a directional pole-mounted light arrangement. For convenience in the description herein, the light arrangement will be referenced as having a lit side and a dark side. Light is directed to the lit side and away from the dark side. The mounting member 17 is on both the lit side and the dark side. The mounting member portion 17L on the lit side is between the pole and the illuminated area (the road and the buffer zone). The mounting member portion 17D on the dark side is between the pole and the restricted or dark area 49 (shown with buildings, such as residences). The mounting adapter 51 allows luminaires to be located on the dark side of the mounting member, with the luminaires oriented to emit light to the lit area.

Note that the dark area 49 need not be absolutely dark. The dark area 49 may have its own lights in the form of street lights, yard lights, house lights, etc. Also, light from the light arrangement may find its way to the dark area. For example, on a humid night, the atmosphere may scatter or reflect light. With the present invention, however, the amount of light reaching the dark area from the light arrangement is severely reduced.

Once the luminaire is properly positioned as desired, the set screws in the first and second extension tubes are tightened to hold the position. Then, holes are drilled through the openings 71. Respective bolts are then inserted into the openings and secured in place with nuts so as to permanently secure the first portion 53 to the tenon 25, the second portion 55 to the first portion 53, and the luminaire 27 to the second portion 55. The caps 63 are installed onto the respective ends of the first and second mounting tubes; the caps have a friction fit. Alternatively, the caps can be threaded onto the first and second mounting tubes.

The same operation is repeated for the other luminaires on the ring. Once all the lights have been installed, the ring may be raised up the pole to its top operating position.

Note that the mounting adapter 51 can be used on new installations as well as existing installations. The mounting adapter is well suited for existing mounting rings with tenons and do not require a modification of the mounting rings.

In existing installations, the pole-mounted light arrangement can be retrofitted or modified so that the luminaires are directed away from dark areas. To retrofit, the mounting member is accessed. For a high mast light arrangement, the mounting member is lowered to the ground. The luminaires are removed from the mounting member and replaced with mounting adaptors 51. Then, the luminaires are mounted to the mounting adaptors. Once the luminaires are mounted, they are oriented so as to direct light toward the desired light area or areas and away from the desired dark area or areas. The mounting member is then raised to its operational position.

Whether retrofitting an existing light arrangement, or configuring a new light arrangement, mounting adaptors need not be used on all the luminaires. For example, in FIG. 3, luminaires 27A can be directly mounted to the tenons 25 and project radially out from the pole, while luminaires 27B, 27C which do not project in the direction of the tenons, can be mounted by way of the mounting adaptors 51.

The advantage of using mounting adaptors is that the mounting member itself may not be modified. Thus, a single design and size of mounting member could be used for any pole, regardless of the pattern of light. The same design mounting member can be used for pole which has a 360 degree light pattern (FIG. 2), a 180 degree light pattern (FIG. 3) for some other light pattern.

Figure 8:
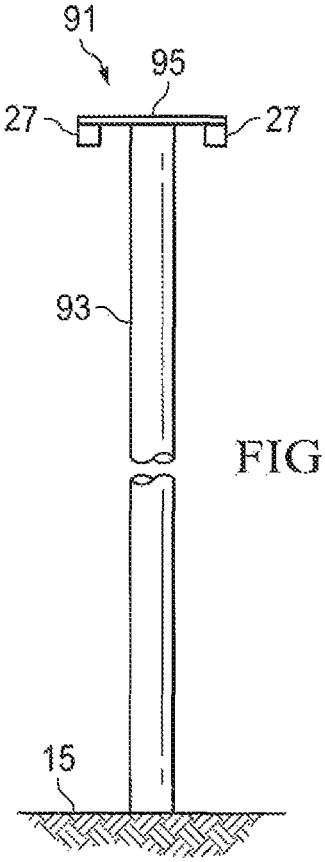
FIG. 8 is an elevational view of a pole-mounted light arrangement.

In addition to high mast light arrangements, the present invention can be used with other pole-mounted light arrangements. FIG. 8 shows such a pole-mounted light arrangement 91. It has a pole 93, a mounting member 95 and luminaires 27. The pole 93 is shorter than the high mast 13 of FIG. 1, and may extend between 15-50 feet tall.

Located at the top end of the pole 93 is the mounting member 95. The mounting member 95 is fixed to the pole and cannot be raised or lowered. Maintenance is performed by way of an aerial bucket, which allows personnel to access the lights mounted to the mounting member.

Figure 9:
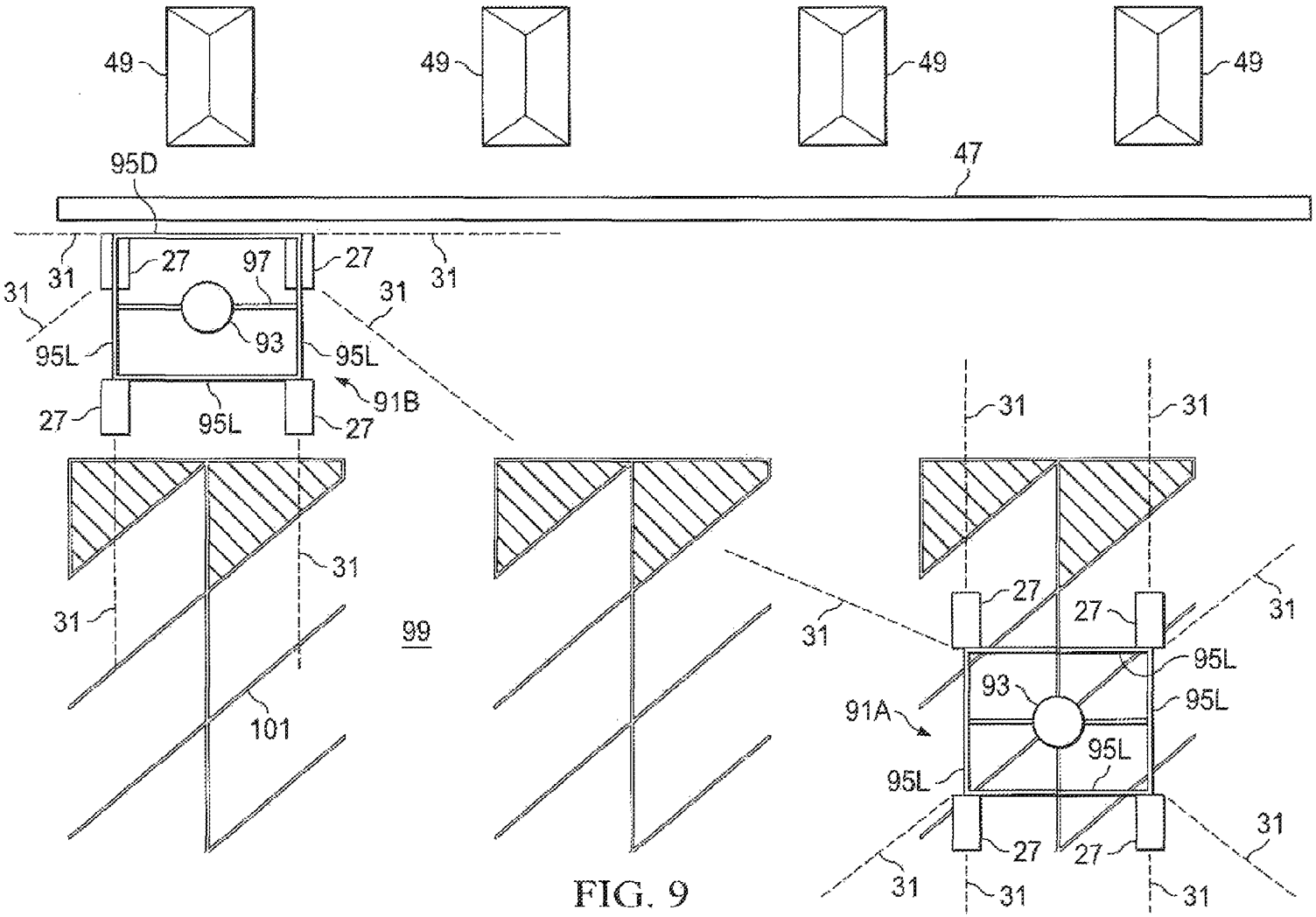
FIG. 9 is a plan view of pole-mounted light arrangements installed in a parking lot adjacent to a residential neighborhood.

FIG. 9 shows an exemplary application of the pole-mounted light arrangements. Each light arrangement has luminaires 27 mounted to the mounting member 95 by way of mounting adapters. Spokes or supports 97 extend from the respective pole to the respective mounting member. The light arrangements are located in a parking lot 99 to illuminate parking spaces 101 and the lanes therebetween. One of the pole-mounted light arrangements 91A is shown located well within the boundaries of the parking lot. The light arrangement 91A provides light 31 360 degrees over the ground in a downward direction.

However, another light arrangement 91B is located adjacent to a neighborhood or light restricted area 49. Instead of providing light in all directions, light 31 is directed to the area to be illuminated (the parking lot 99) and away from the neighborhood 49.

The mounting member 95 of both light arrangements is rectangular or square in plan view. Each mounting member has four sides. The mounting member of the light arrangement 91B has a dark side 95D located between the pole 93 and the neighborhood 49 and three lit sides 95L located between the pole and the area 99 to be illuminated. The mounting adapter 51 allows the luminaires 27 mounted to the dark side 95D to be oriented so as to direct the light to the parking lot. Thus, even the dark side 95D of the mounting member can be used to supply lights.

Figure 10A:
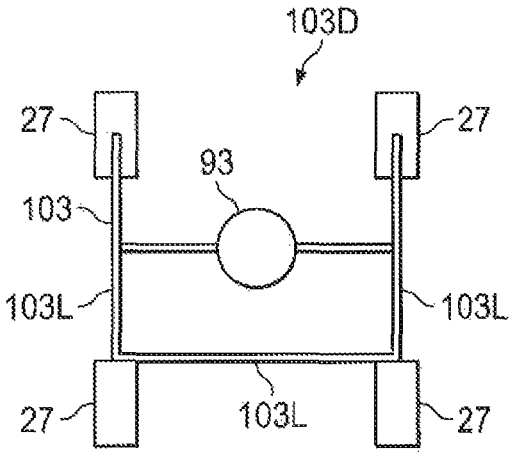
FIGS. 10A-10D are plan views of alternate mounting members equipped with the mounting adapter.

Alternative mounting members are shown in FIGS. 10A-10D. Each mounting member has a pole 93, supports 97 and luminaires 27 mounted thereto. FIG. 10A shows a mounting member 103 having a "U" shape. The dark side 103D is shown at the top of the figure and includes the free ends of the mounting member. The luminaires 27 are shown oriented away from the dark side and toward the lit sides 103L. The luminaires on the dark side 103D are mounted to the free ends of the mounting member.

Figure 10B:
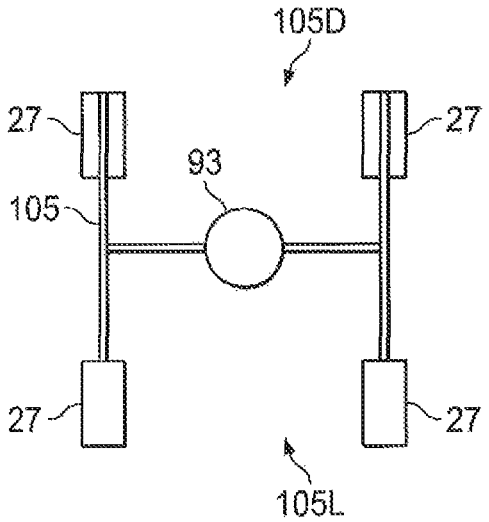

FIG. 10B shows an "H" shaped mounting member 105 in plan view. Like the mounting member 103 of FIG. 10B, the dark side is actually a gap between two mounting member portions. The luminaires are located on the ends of the "H" and are oriented toward the lit side 105L.

Figure 10C:
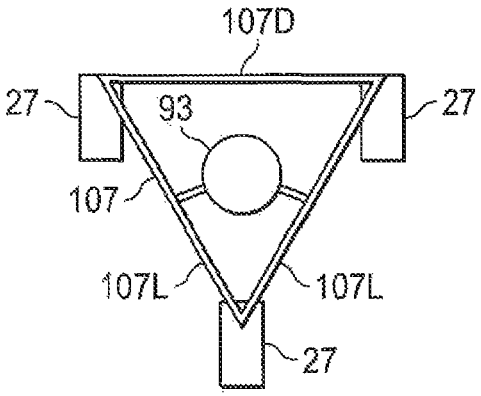

FIG. 10C shows a triangular shaped mounting member 107. The dark side 107D is one side of the triangle. The luminaires are oriented toward the opposite side or lit side 107L.

Figure 10D:
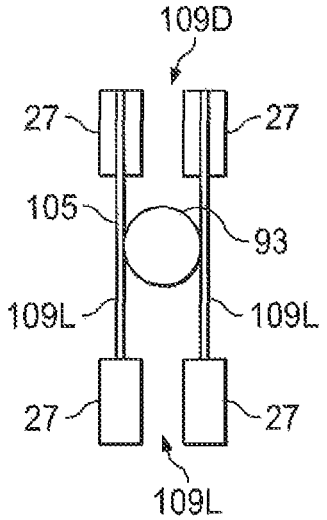

FIG. 10D shows a mounting member in accordance with another embodiment. This mounting member has two parallel bars mounted to the pole 93. Each end of the bars has a luminaire 27, which luminaires are oriented toward the lit side and away from the dark side 109D.

With regard to the mounting members shown in FIGS. 10A-10D, they can be oriented so the dark side is another portion of the individual mounting members. For example, the "U" shaped mounting member of FIG. 10A can be oriented so as to have its dark side not along the gap as shown, but along one of the side portions.

Allowing adjustment of the position and orientation of individual luminaires on a high mast pole, the direction of light can be controlled so as to minimize lighting of sensitive areas such as neighborhoods.

The foregoing disclosure and showings made in the drawings are merely illustrative of the principles of this invention and are not to be interpreted in a limiting sense.

The invention claimed is:

1. An outside lighting arrangement, comprising:

a. a vertical pole having a lower end mounted to the ground and an upper end, the pole comprising a dark side and a light side;

b. a mounting member coupled to the upper end of the pole, the mounting member having plural luminaire mounting positions, located circumferentially around the pole and offset from the pole, with at least one of the luminaire mounting positions located on the light side of the pole and another of the luminaire mounting positions located on the dark side of the pole;

c. plural luminaires, each luminaire having a front and a rear, each luminaire being directional;

d. plural mounting adapters, each comprising a first portion that couples to the mounting member at a respective one of the luminaire mounting positions, and a second portion that couples to a respective one of the luminaires, the respective second portion being rotatably coupled to the respective first portion so as to direct light from the respective luminaire in the desired direction and away from the dark side.

2. The outside lighting arrangement of claim wherein the luminaire mounting positions each comprises a tenon projecting radially from the mounting member.

3. The outside lighting arrangement of claim 2 wherein each of the respective first portions comprise a first mounting tube having two ends, with one end of the first mounting tube coupled to one of the tenons, the respective first portion comprising a first extension tube that extends from the first mounting tube, the respective first extension tube rotatably coupled to the respective second portion.

4. The outside lighting arrangement of claim 1 wherein each of the respective first comprise a first mounting tube having two ends, with one end of the first mounting tube coupled to the mounting member at one of the luminaire mounting positions, the respective first portion comprising a first extension tube that extends from the first mounting tube, the respective first extension tube rotatably coupled to the respective second portion.

5. The outside lighting arrangement of claim 1 wherein the mounting member is horizontal.

6. The outside lighting arrangement of claim 5 wherein the pole has a dark side and a light side, with at least one of the luminaire mounting positions being on the dark side, the luminaires oriented so as to direct light toward the light side and away from the dark side.

7. The outside lighting arrangement of claim 5, wherein each of the luminaires directs its light toward the luminaire front.

8. The outside lighting arrangement of claim 7 where at least one of the luminaires is oriented about the pole so that the respective front is away from the pole and another one of the luminaires is oriented about the pole so that respective front is toward the pole.

9. The outside lighting arrangement of claim 1 wherein the mounting member comprises a ring supported by spokes, the mounting member capable of being raised and lowered along the pole.

10. An outside lighting arrangement, comprising:

a. a vertical pole having a lower end mounted to the ground and an upper end;

b. a mounting member coupled to the upper end of the pole, the mounting member having plural luminaire mounting positions, located circumferentially around the pole and offset from the pole;

c. plural luminaires, each luminaire having a front and a rear, each luminaire being directional;

d. plural mounting adapters, each comprising a first portion that couples to the mounting member at a respective one of the luminaire mounting positions, and a second portion that couples to a respective one of the luminaires, the respective second portion being rotatably coupled to the respective first portion so as to direct light from the respective luminaire in the desired direction;

e. wherein the respective first portion comprises a first mounting tube having two ends, with one end of the first mounting tube coupled to one of the tenons, the respective first portion comprising a first extension tube that extends from the first mounting tube, the first extension tube rotatably coupled to the respective second portion;

f. wherein the respective second portion comprises a second mounting tube and a second extension tube, the second mounting tube having two ends, with one end coupled to the respective luminaire, the second extension tube extending from the second mounting tube, the second extension tube being telescopically coupled to the respective first extension tube.

11. An outside lighting arrangement, comprising:

a. a vertical pole having a lower end mounted to the ground and an upper end;

b. a mounting member coupled to the upper end of the pole, the mounting member having plural luminaire mounting positions, located circumferentially around the pole and offset from the pole;

c. plural luminaires, each luminaire having a front and a rear, each luminaire being directional;

d. plural a mounting adapters, each comprising a first portion that couples to the mounting member at a respective one of the luminaire mounting positions, and a second portion that couples to a respective one of the luminaires, the respective second portion being rotatably coupled to the respective first portion so as to direct light from the respective luminaire in the desired direction;

e) wherein the respective first portion comprises a first mounting tube having two ends, with one end of the first mounting tube coupled to the mounting member at one of the luminaire mounting positions, the respective first portion comprising a first extension tube that extends from the first mounting tube, the first extension tube rotatably coupled to the respective second portion;

f) wherein the respective second portion comprises a second mounting tube and a second extension tube, the second mounting tube having two ends, with one end coupled to the respective luminaire, the second extension tube extending from the second mounting tube, the second extension tube being telescopically coupled to the respective first extension tube.

12. The outside lighting arrangement of claim 11 wherein the other end of the first extension tube is closed and the other end of the second extension tube is closed.

13. A method of modifying an outside lighting arrangement used to illuminate a lighted area and located adjacent to a dark area, the outside lighting arrangement comprising a vertical pole having a base on the ground and an upper end vertically above the base, a mounting member and a plurality of directional luminaires, comprising the steps of:

a. locating luminaire mounting positions on the mounting member, with at least one of the luminaire mounting positions adjacent to the dark area and another of the luminaire mounting positions adjacent to the light area;

b. identifying those luminaire mounting positions that are adjacent to the dark area;

c. providing those identified luminaire mounting position that is adjacent to the dark area with a mounting adapter;

d. mounting a respective one of the luminaires to the mounting member in the luminaire mounting position adjacent to the dark area by the respective mounting adaptors and mounting another of the respective luminaires to the mounting member in the luminaire mounting positions adjacent to the light area;

e. orienting the luminaires on the mounting adapter so as to direct light away from the dark area and toward the light area.

14. The method of claim 13 further comprising the step of lowering the mounting member from an upper end of the vertical pole to near the ground level, while maintaining the pole upper end in position so as to provide mounting adaptors to the identified luminaire mounting positions.

* * * * *